United States Patent [19]

Hollingsworth

[11] Patent Number: 4,807,761

[45] Date of Patent: Feb. 28, 1989

[54] HYDRAULIC SEPARATING METHOD AND APPARATUS

[75] Inventor: Clinton A. Hollingsworth, Lakeland, Fla.

[73] Assignee: C-H Development & Sales, Inc., Lakeland, Fla.

[21] Appl. No.: 27,170

[22] Filed: Mar. 17, 1987

Related U.S. Application Data

[63] Continuation-in-part of Ser. No. 534,975, Sep. 22, 1983, Pat. No. 4,539,103, and a continuation-in-part of Ser. No. 368,625, Apr. 15, 1982, abandoned, and a continuation-in-part of Ser. No. 338,341, Jan. 11, 1982, abandoned, and a continuation-in-part of Ser. No. 716,973, Mar. 28, 1985, abandoned, and a continuation-in-part of Ser. No. 924,290, Oct. 29, 1986, abandoned.

[51] Int. Cl.[4] ..... B03B 5/66

[52] U.S. Cl. ..... 209/158; 209/211; 209/454

[58] Field of Search ..... 209/17, 158–161, 209/211, 454, 456

[56] References Cited

U.S. PATENT DOCUMENTS

| | | | |
|---|---|---|---|
| 880,430 | 2/1908 | Veitch | 209/211 |
| 1,054,799 | 3/1913 | Skimner | 209/424 |
| 1,205,673 | 11/1916 | Shahan | 209/158 |
| 1,490,420 | 4/1924 | Elder | 209/454 |
| 1,705,351 | 3/1929 | Andrews | 209/454 |
| 2,629,496 | 2/1953 | Laughlin | 209/454 |
| 2,967,617 | 1/1961 | Evans et al. | 209/211 |
| 3,237,767 | 3/1966 | Fowle et al. | 209/160 |
| 3,280,975 | 10/1966 | Evans | 209/158 |
| 3,282,422 | 11/1966 | Reynolds et al. | 209/158 |
| 3,308,951 | 3/1967 | Evans | 209/158 |
| 3,708,063 | 1/1973 | Morimasa | 209/158 |
| 3,801,370 | 4/1974 | Porter et al. | 209/159 |
| 4,022,685 | 5/1977 | Tisseau | 209/158 |
| 4,272,251 | 6/1981 | Beckberger et al. | 209/158 |
| 4,539,103 | 9/1985 | Hollingsworth | 209/211 |

FOREIGN PATENT DOCUMENTS

| | | | |
|---|---|---|---|
| 1014448 | 6/1952 | France | 209/158 |
| 278561 | 10/1927 | United Kingdom | 209/454 |
| 794271 | 4/1958 | United Kingdom . | |
| 819173 | 9/1959 | United Kingdom | 209/158 |
| 1557354 | 12/1979 | United Kingdom . | |
| 2060439 | 5/1981 | United Kingdom . | |
| 2104415 | 3/1983 | United Kingdom . | |

*Primary Examiner*—James B. Marbert
*Assistant Examiner*—Donald T. Hajec
*Attorney, Agent, or Firm*—Flehr, Hohbach, Test, Albritton & Herbert

[57] ABSTRACT

Apparatus and method for the separation of solid particles from hydrous slurries being particles of different settling velocities, such as slurries containing minerals including ore solids, coal and sands. The slurry solids are subjected to the jetting action of water discharged through barrier plate openings to effect separation between particles of greater settling velocity, which progress downwardly through the openings and are discharged in an underflow, and particles of lower velocity that progress upwardly and are discharged in an overflow.

12 Claims, 3 Drawing Sheets

HYDRAULIC SEPARATING METHOD AND APPARATUS

This application is a continuation-in-part of my copending applications Ser. No. 534,975 filed Sept. 22, 1983 now U.S. Pat. No. 4,539,103, Ser. No. 368,625 filed Apr. 15, 1982, and Ser. No. 338,341 filed Jan. 11, 1982, Ser. No. 716,973 filed Mar. 28, 1985, all now abandoned and Ser. No. 924,290 filed Oct. 29, 1986 now abandoned.

This invention relates generally to methods and apparatus for separating the solid particles of hydrous slurries or pulps into two or more fractions containing particles of different settling velocities. The invention is applicable to various slurries, such as those containing minerals like ore solids, coal and sands.

Many sizing and classifying methods employ gravity separation of solid particles of a hydrous slurry, the separation being dependent on the differences in the settling rates or settling velocities of the particles in a relatively quiescent body of water. The apparatus may consist of a settling tank having means for introducing the slurry, an upper overflow weir and launder for receiving an overflow, and means for removing an underflow from a lower portion of the tank. In operation, water may be continuously introduced into the lower portion of the tank to provide an upward flow of water such as to create the condition of "teeter" whereby solids of greater settling velocity progress downwardly to be discharged in the underflow and particles of lesser settling rate progress upwardly to be discharged in the overflow. The different settling velocities of the solid particles of the slurry may be by virtue of particles differing in size, particles of different substances differing in their densities, or both. In some instances (e.g. U.S. Pat. No. 2,967,617, Jan. 10, 1961) the tank is provided with a perforated barrier, commonly known as a constriction barrier or plate which divides the interior of the tank into a main upper chamber and a lower space below the barrier. Water introduced into the lower space flows upwardly through the barrier. Particles of greater settling velocities that settle into the region adjacent the upper side of the constriction plate are removed in the underflow, as by means of a siphon. When such apparatus and methods make use of a teeter zone, maintenance of this zone is relied upon to effect the principal separating action.

Methods and apparatus of the above type are subject to certain disadvantages and limitations. For example, the separation may not be as sharp as desired, particularly for certain types of slurries. Also the apparatus may be excessively elaborate in structural detail and size for the capacity or the sharpness of separation desired. In addition, the sharpness of separation tends to be subject to variations, particularly when a teeter zone is relied upon to effect the primary separation. Such variations may occur when there are changes in the solids content of the feed or in the relative amounts of the solids in the feed having different settling velocities. The size of such equipment is relatively large for a given processing capacity.

An object of the invention is to improve upon hydraulic separating methods and apparatus, particularly with respect to providing a desired sharpness of separation.

Another object is to provide a separating method and apparatus which facilitates maintenance of optimum separating conditions and does not depend upon a teeter zone.

In general the present invention makes use of apparatus comprising the upright tank having overflow discharge means at its upper end, and special barrier means in the form of a plate located between the upper main separating chamber of the tank and the space in the lower portion of the tank below the barrier plate. Means is provided for introducing a feed slurry tangentially into the upper chamber and also means for introducing water into the space below the barrier plate. Additional means is provided for withdrawing an underflow fraction containing solid particles of greater settling velocity. The barrier plate has openings that are of a diameter sufficient to pass the heavier underflow particles. The method carried out with such apparatus includes introducing a feed slurry tangentially into the chamber above the barrier plate to form a swirling body of material therein extending from the overflow means to the barrier plate. Water is continuously introduced into the space below the barrier plate, whereby it flows upwardly through the openings in the barrier plate to merge with the body of material above the plate. Water introduced below the barrier plate flows upwardly through the openings in the plate and is caused to create a jetting action which extends upwardly from the openings. This effects separation between particles of different settling velocities, the action being such that particles of greater settling velocities pass downwardly through the openings, and particles of lower settling velocities are carried upwardly and eventually are discharged in the overflow from the upper end of the tank. The particles passing downwardly through the openings are collected and discharged as the underflow. The barrier plate may also be described as a velocity plate.

Additional objects and features of the invention will appear from the following description in which the preferred embodiments are set forth in detail in conjunction with the accompanying drawing.

Referring to the drawing

Figure 1:
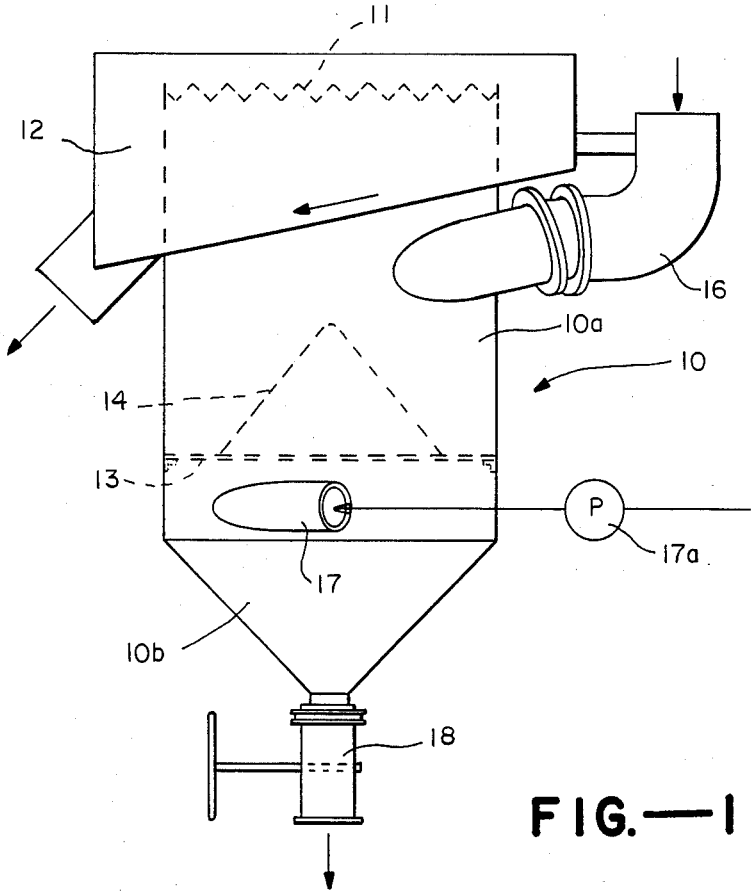
FIG. 1 is a side elevational view illustrating apparatus in accordance with the present invention.

The apparatus shown in FIG. 1 consists of a tank 10 which, in this instance, has a cylindrical section **10*a* and a lower conical section 10*b*. At the upper end of the tank there is an overflow weir 11 which delivers the overflow material into the surrounding launder 12 and may be of the saw tooth type. Mounted within the lower part of the cylindrical section 10*a* there is a perforated barrier 13, which is in the form of a laterally extending plate. Preferably an imperforate cone 14 is positioned upon the barrier 13 and is aligned with the central axis of the tank. The base of this cone is dimensioned whereby a substantial annular portion of the barrier plate extends between the side walls of the tank and the base of the cone. As shown particularly in FIG. 2, the barrier plate is provided with two rows of openings 15. For example, when the feed material is a natural sand comprising both coarse and fine sand particles, the openings 15**, which each have a cross-sectional flow area that is substantially the same for its entire length, may have a diameter of the order of ¾ inch. This is in contrast with standard constriction plate practice, where the openings in a typical constriction plate are of relatively small diameter (e.g. ¼ inch), for operation with a comparable feed slurry.

Figure 2:
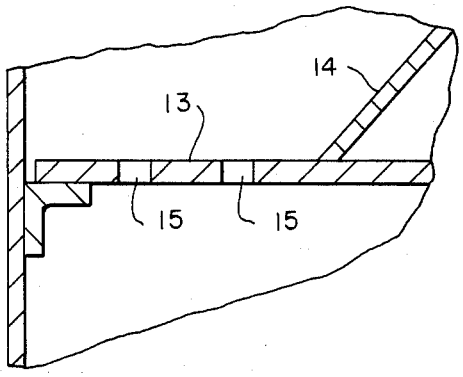
FIG. 2 is a detail in section showing a portion of the barrier plate and the openings through the same.
Figure 3:
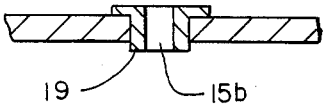
FIG. 3 is a detail in section of a portion of the barrier plate, illustrating inserts for providing the desired openings.

The vertical length of each opening may, for example, be proportioned as shown in FIG. 2 (e.g., ⅝ inch for each ¾ inch diameter hole), or as shown for example in FIG. 3, 1.5 inches for each ¾ inch hole.

As shown in FIG. 3 the barrier plate may be fitted with the removable plastic inserts 19, which provide the openings **15*b*** of suitable diameter and length. Such fittings may be replaceable to adjust the diameter and length of the openings.

The feed slurry is fed into section **10*a* of the tank through conduit 16. This conduit connects tangentially with the tank as shown in FIG. 1. The region of connection is located intermediate the upper end of the tank and the barrier 13**.

In operation the particles of higher settling velocities pass downwardly through the openings 15 and are collected in the lower portion **10*b* of the tank. A conduit or pipe 17 serves to introduce water into the space below the barrier plate, and is shown connected tangentially through one side wall of the tank below the level of the barrier late. It is connected to pumping means 17*a* which serves to deliver water into the space below the barrier plate at a substantially constant flow rate. The heavier separated material, constituting the underflow, may be removed from the tank through the valve 18**.

One mode of operation of the invention, making use of the apparatus described above, is as follows. It is assumed that the slurry consists of a natural sand having solid particles of different sizes and settling velocities. The coarser particles of the sand are silica, and the finer particles are likewise silica together with some clay or other fine solids. The solids content of the slurry may be of the order of 22%. In a start-up operation slurry is introduced into the tank through pipe 16 and at the same time water is supplied through pipe 17 to the space below the barrier 13. When the tank is completely filled, the sand slurry is continuously supplied through pipe 16 at a substantially constant head, and because this pipe connects tangentially with the tank, the main body of material above the barrier plate is caused to swirl about the central axis of the tank. Water is continuously supplied through the pipe 17 into the section **10*b* below the barrier plate, and at a substantially constant flow rate. This water is caused to flow upwardly through the openings 15 in the barrier plate, thereby creating a jetting action which extends with diminishing velocity a substantial distance above the barrier. Water introduced tangentially below the barrier causes swirling movement which may be in the same direction as in the upper tank section 10*a***.

Figure 4:
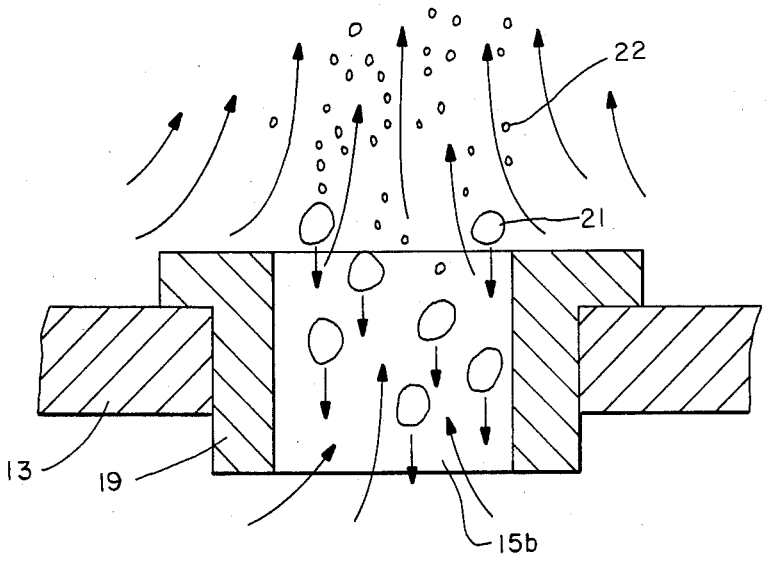
FIG. 4 is an enlarged detail in section graphically illustrating one embodiment of the separating action provided by the water flowing upwardly through the openings of the barrier plate with jetting action extending above the plate.

FIG. 4, which is exaggerated as to scale, serves schematically to illustrate the jetting and separating action which takes place under certain conditions, such as when the rate of introduction of water below the plate allows the desired coarse or heavy particles to pass through each hole and inhibits the fine or light particles from passing through. Slurry particles in the vicinity of each opening 15 tend to be drawn into the water jetting upwardly from the opening, as indicated by the arrows in FIG. 4, and the larger particles 21, which are presumed to have the greater settling velocities, progress downwardly through the jetting water, through the openings 15, and into the space below the barrier. The finer particles 22 of the slurry which have the lower settling velocities, are carried upwardly into the main body of material above the barrier, and eventually are discharged in the overflow. The water jets above the holes tend to be more or less inclined by an amount depending upon the intensity of the swirling movement about the plate.

Figure 5:
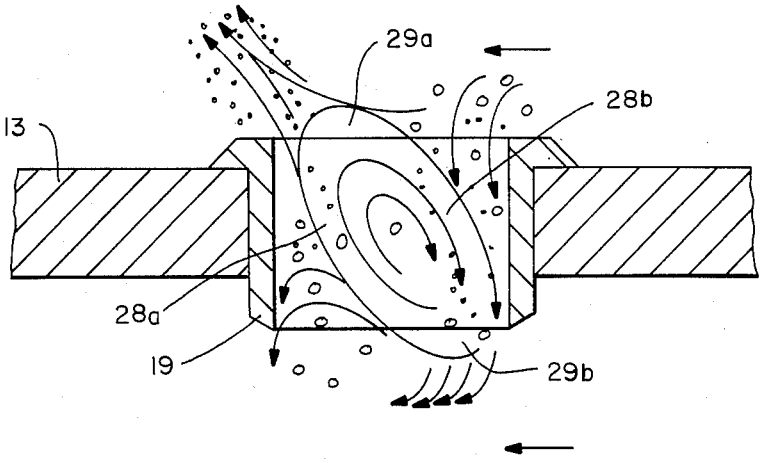
FIG. 5 is an enlarged detail graphically illustrating an eddy within an opening, which is deemed to play a part in the separating action when the preferred mode of operation is employed.

Although the upward flow through each hole of the plate may be less than the settling rate of the coarse, heavier particles, in practice it has been found that with a feed slurry of natural sand, best results are obtained when each of the holes in the barrier are proportioned substantially as shown in FIG. 5 (e.g., ¾ inch diameter hole, ¾ inch in length), with the amount of water flowing through each hole from the space below the plate at a flow rate that is substantially greater than the settling rate of the underflow particles. This effect is deemed to be due to eddy currents produced in the individual holes in the barrier due to swirling action. Tests have been made using a laboratory model made of transparent plastic material which permits visual observation of solid particles moving through each hole of the barrier plate when operating under such conditions. An eddy current was observed within each hole which caused heavier particles to be carried into the hole and to be delivered from the lower end of the hole. The form of the eddy currents, as viewed through the periphery of the circular barrier plate and looking toward the central axis of the tank, was such as to create a pronounced eddy in which water surged upwardly along one side of the hole from the lower to the upper side of the barrier plate and downwardly on the other side of the hole. This is schematically shown in FIG. 5. The upper ends of the side portions **28*a* and 28*b* of each eddy are connected by potions 29*a*, and the lower ends of the side portions are connected by portions 29*b***.

The flow path of the eddy appears to be oval, and is a continuous flowing stream which sweeps upwardly and downwardly past diametrically opposite side surfaces of the hole and across upper and lower ends of the hole. Particles in the region immediately above the barrier plate, which consist mainly of coarse or heavier particles with a minor portion of the fine material, are drawn into the eddy, progressed downwardly in the downwardly flowing eddy portion **28*b* and then discharged from the eddy into the space below the barrier. A minor portion of fine material is carried into the eddy and is returned to the upper side of the barrier plate by portion 28. The swirling movement of feed slurry above the barrier, appears to supply energy to maintain the eddy current action. Swirling movement of the water below the barrier plate likewise contributes energy to maintain the eddy currents. Water sweeping across the ends of a hole due to swirling of the water below the plate appears to react against the side surfaces of the hole, thus contributing to maintenance of the eddy current. As indicated in FIG. 5**, the eddy current is in an oval path about an axis that is radial to the vertical axis of the tank. The upward discharge from the plate is inclined due to the swirling action above the plate. Concurrent swirling action both below and above the plate is deemed preferable for optimum results, although countercurrent swirling can be used.

To utilize the eddy effect to best advantage, certain dimensions and operating conditions are required. The ratio between hole diameter and length should be within certain limits, and the amount of water flowing through the holes from the space below the barrier should be such as to cause water to pass upwardly through the holes at a rate which, in the absence of the eddy, would be substantially greater than the settling velocity of the underflow solids. The swirling movement of the material in the upper tank section 10*a* provides some preliminary separation by gravity settling. It is believed that the static pressure within the eddy is sufficiently low to induce heavier particles from the jet to enter the eddy, and that the velocity of the eddying water is such that the heavier particles are carried through the hole and discharged into the space below the barrier plate. Assuming that the feed slurry is a natural sand, the ratio of hole diameter to hole length can be within the range of about 1 to 0.8, to 1 to 1.8 with holes having a diameter ranging from $\frac{5}{8}$ to $1\frac{3}{4}$ inches. The settling velocity of the underflow solids in a typical instance may be about 17 feet per minute, and the amount of water passing upwardly through each of the holes may be within a range of about 0.2 to 10 gallons per minute, which in the absence of eddy currents would provide a flow velocity of from 8 to 43 feet per minute. These figures may vary somewhat for optimum results, using slurries differing in screen mesh analysis.

Good sharp separation is obtained with operation as described above. Some preliminary separation by gravity settling takes place in the upper tank part 10*a*. The heavier particles are acted upon by the jetting water above the barrier and then by the eddies that deliver the heavier particles into the space below the barrier. A minimum amount of fine overflow particles that accompany the underflow particles into the holes are cycled back by the eddies into the space overlaying the barrier plate. The kinetic energy that maintains the eddies is deemed to be derived from the swirling action above and below the barrier plate. Some gravity settling separation commences immediately following tangential introduction of the feed slurry and continues as the overflow fines progress upwardly to the overflow weir and as underflow material progresses downwardly toward the barrier plate. When operating in this manner, relatively high capacity can be attained with compact equipment which is relatively insensitive to variations such as changes in the feed rate, or in the solids content of the feed, or in the relative amounts of solids having different settling velocities.

A feature of the invention is that it does not depend upon the maintenance of a teeter zone in the upper body of material for effective separating action. The swirling action of the slurry and water in tank portion 10*a* promotes effective separation by the jetting action because it causes continuous motion about the axis of the tank in the region above the barrier plate where the jetting action is effective. Swirling motion also aids in carrying particles of the slurry into the active regions of the upwardly jetting water.

Figure 6:
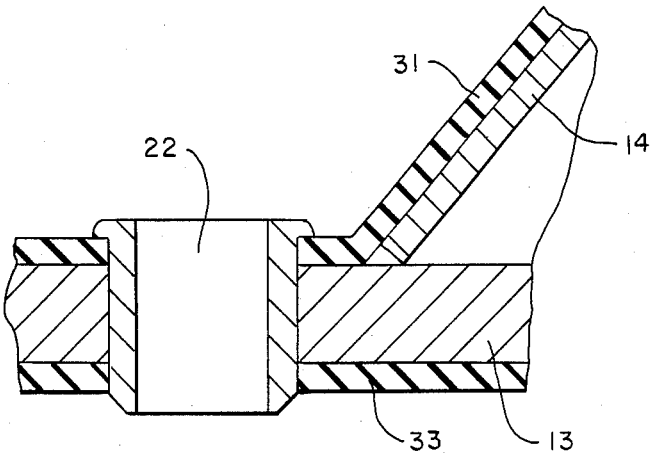
FIG. 6 illustrates a construction in which the barrier plate is provided with abrasion resistant lining.

FIG. 6 shows a barrier plate construction with an abrasion resistant liner 31 such as rubber. The liner 31 extends over plate 13, about each adapter 32 and over the cone 14. The lower surface of plate 13 may be covered by liner 33.

Figure 7:
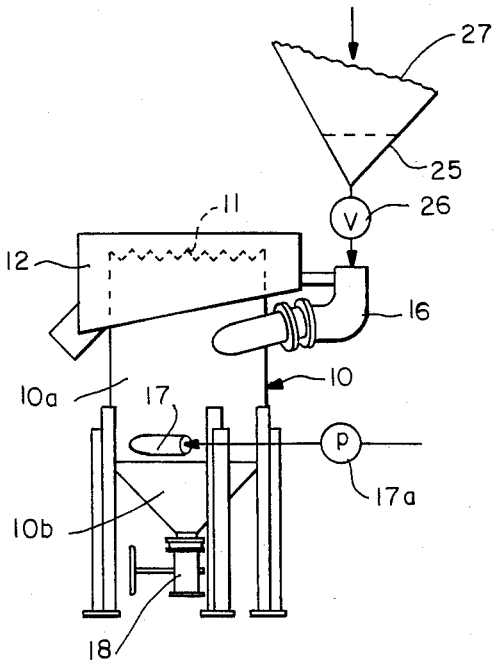
FIG. 7 is a detail in side elevation illustrating an installation of the invention together with slurry feed means.

FIG. 7 schematically illustrates an installation of the apparatus. A feed hopper 25 is shown connected to the feed pipe 16, through a suitable control valve 26, and the feed slurry is discharged upon the screen 27, which overlies hopper 25. The screen serves to remove oversized material.

Examples of the invention are as follows.

EXAMPLE 1

Laboratory tests were made to determine data for the construction and operation of commercial equipment. The laboratory apparatus consisted of a cylindrical vessel made of transparent plastic, forming a chamber having an internal diameter of 3.25 inches and a height of about 24 inches. The top of the vessel formed an overflow weir and a collecting launder. At the lower end of the vessel there was a conical extension. A barrier plate was removably mounted near the lower end of the cylindrical portion of the vessel. The lower end of the conical extension was closed by a valve, which could be opened for the discharge of underflow material. The feed was introduced tangentially into the chamber intermediate the top of the chamber and the barrier plate, and water was introduced into the space below the barrier. The barrier plate was constructed to operate as a velocity plate. It was provided with three openings, each $\frac{5}{8}$ inch in diameter. The underflow draw-off pipe connected with the bottom of the vessel below the plate, and the plate was located 15.5 inches below the top of the vessel. The hole area was about 11.1% of the total exposed barrier plate area. Water was introduced below the barrier plate at a pressure of about 3.5 psi. A feed slurry of natural sand was introduced at the rate of about 2.7 gallons per minute. Water was introduced into the bottom of the vessel below the velocity plate at a rate of about 2.7 gallons per minute. The feed slurry contained 18.2% solid particles, and was introduced at the rate of about 300 lbs. per hour. After a period of operation, a screen analysis was made of the solids in the underflow and overflow. It was found that 97.3% of the solids of the underflow were plus 48 mesh (Tyler Standard screen). Only 0.7% of the solid particles of the overflow were plus 28 mesh.

EXAMPLE 2

This example is with respect to apparatus made substantially as shown in FIG. 1, and suitable for commercial operation. The plate was of the velocity plate type, making use of jetting action through openings in the barrier to effect separation between the coarse and finer particles. The barrier also is provided with an imperforate cone 14. The cylindrical portion 10a of the tank had a height of about 5.75 feet, and an internal diameter of 4.5 feet. The velocity barrier was located about 4.5 feet from the top of the tank. A typical slurry that may be processed for sizing, is a natural sand having coarse particles, the bulk of which are plus 48 mesh, and relatively finer particles. Typical operating conditions for effecting separation between the coarse and fine particles of such a feed slurry, are as follows. The slurry is prepared to have a desired solids content (e.g., 23%), which in practice may vary during operation. The feed slurry is fed through the pipe 16 under a hydrostatic head of the order of 18 inches. Assuming that the slurry is supplied to the tank through pipe 16 at the rate of 1,500 gallons per minute, water is supplied through tangential pipe 17 into the space below the barrier plate at the rate of about 600 gallons per minute. The barrier plate had three rows of openings disposed on different diameters, with each opening ¾ inches in diameter and ⅝ inches in length. The exposed annular area of the barrier, namely that annular portion between the side walls of the tank and the base of the cone 14, was about 1,230 square inches. The open hole area was 92.3 square inches. The valve 18 for discharge of the underflow was manually controlled. Assuming construction and operating conditions as described above, there was effective separation between the coarser and finer sand particles, whereby about 94% of the coarse particles in the underflow was plus 48 mesh, and only 0.4% of the solids in the overflow was plus 28 mesh. The flow rate of water flowing upwardly through each opening, with the above construction and operating conditions, was about 2.2 gallons per minute, in contrast with the settling velocity of the heavier particles of about 17 feet per minute.

EXAMPLE 3

The apparatus was that used in Example 2 except that the hole were 1.25 inches in diameter and 1.5 inches in length. The same sand slurry was introduced into the upper region of the tank at the rate of 1517 gallons per minute and water was supplied to the lower region of the tank at the rate of 650 gallons per minute. There was effective separation whereby about 92% of the heavier particles of the underflow was plus 48 mesh and only 0.4% of the solids in the overflow was plus 28%. However the separating capacity was about 38% greater than in Example 2.

What is claimed is:

1. Apparatus for the separation of solid mineral particles in a hydrous mineral slurry, the particles having different settling velocities, comprising an upright tank having means for discharge of an overflow from an upper region of the tank and means for discharge of an underflow from a lower region of the tank, barrier means disposed between the upper and lower regions of the tank for separating the regions, said barrier means comprising an annular plate portion having spaced openings therethrough communicating between the upper and lower regions and distributed over said annular plate portion, the total area of the openings being a minor percent of the total area of the annular plate portion, means for supplying a hydrous slurry tangentially into the upper tank region to cause swirling of the material in the upper region of the tank, means for introducing water under pressure into the lower tank region below the barrier means to cause jet-like flow of water to be discharged upwardly through each of the openings of the annular plate portion, and from thence extending into that portion of the upper region of the tank immediately overlaying the barrier means, and an imperforate conical member positioned with its base disposed at the inner perimeter of said annular plate portion of the barrier means, and with its apex extending upwardly in the upper region of the tank, said conical member serving as means for directing particles progressing downwardly in the upper region of the tank into that portion of the upper region immediately above said annular portion of the barrier, whereby solid particles of the slurry in said upper region of the tank are caused to enter the jet-like flow and a separation is carried out between the solid particles of the slurry having different settling velocities, with the particles of lower settling velocity progressing upwardly to be discharged from the upper region of the tank as the overflow and with the particles of greater settling velocity progressing downwardly through the jet-like flow and through the said openings into the lower region of the tank for discharge from the lower tank region as the underflow.

2. Apparatus as in claim 1 in which the means for introducing water into the lower tank region is disposed to introduce the water tangentially to cause the water in the lower tank region to swirl about the central axis of the tank.

3. Apparatus as in claim 1 in which each opening in the barrier means is formed by a fitting made of plastic material and removably fitted into an accommodating opening.

4. A method for the separation of solid mineral particles of a hydrous feed slurry into fractions containing solid particles of different settling velocities, the method making use of an upright tank having means for the discharge of an overflow from an upper tank region, means for discharge of an underflow comprising particles having settling rates higher than the settling rates of particles of the overflow from a lower tank region, barrier means comprising an annular plate portion having openings therethrough and located between the upper and lower tank regions, and an imperforate conical member positioned with its base disposed at the inner perimeter of said annular plate portion and with its apex extending upwardly in the upper region of the tank, the openings having a total area that is a minor percentage of the total area of the annular plate portion; the method comprising delivering the feed slurry tangentially into the upper tank region to maintain a swirling body of material therein extending from the overflow means to the annular plate portion of the barrier means, causing particles of the feed slurry to progress downwardly in the upper region of the tank and to be directed by the conical member into the region immediately above said annular plate portion, introducing water under pressure into the lower tank region so that water from the lower region is caused to flow through the said openings in the annular plate portion, the discharge from the openings being in the form of jet-like flows of water discharging upwardly into the portion of the upper tank region immediately above the annular plate portion at a velocity substantially greater than the upward velocity of water in said region immediately below the annular plate portion, the jet-like flows of water being such that particles of the swirling feed slurry in said portion of the tank immediately above the annular plate portion are caused to enter the same, and flows through each of said openings being such that downward passage of particles of a lower settling velocity through each jet-like flow and barrier opening is inhibited and the particles of higher settling velocity are caused to progress downwardly through each jet-like flow and through the said openings into the lower tank region, so that the particles of lower settling velocity progress upwardly from the region of the barrier means and are discharged from the upper tank region in the overflow way of the overflow means and so that the particles of higher settling velocity pass through said openings in the annular plate portion into the lower tank region to be discharged in the underflow by way of the underflow means, the swirling movement of the body of material in the upper tank region serving to promote movement of particles of the slurry into each of said jet-like flows of water.

5. The method as in claim 4 in which the water is delivered tangentially into the lower tank region to cause swirling movement about the central axis of the tank and adjacent the lower side of the annular plate portion of the barrier means.

6. A method as in claim 4 in which the introduction of water into the lower tank region is at such pressure as to cause the water to flow upwardly through the openings in the annular plate portion at a flow rate substantially greater than the settling velocity of the underflow particles.

7. A method as in claim 4 in which the dimensions of the openings in the annular plate portion are such that the ratio of opening diameter to length is within the range of about 1 to 0.8 hole diameter to 1 to 1.8 hole length, with openings ranging in diameter from $\frac{5}{8}$ to $1\frac{3}{4}$ inches, and the flow of water through each opening being within a range of 0.2 to 10 gallons per minute.

8. A method for the separation of solid mineral particles of a hydrous feed slurry into fractions containing solid particles of different settling velocities, the method making use of an upright tank having means for the discharge of an overflow from an upper tank region, means for discharge of an underflow comprising particles having settling rates higher than the settling rates of particles of the overflow from a lower tank region, and barrier means in the form of a laterally extending plate portion having upwardly extending openings therethrough and located between the upper and lower tank regions, the openings each having a cross-sectional flow area that is substantially the same for the entire length of the opening; the method comprising introducing feed tangentially into the upper region of the tank whereby the material in the upper tank region is caused to swirl about the vertical axis of the tank to maintain a swirling body of material therein extending from the overflow means to the barrier means, introducing water under pressure into the lower tank region, the configuration of each of the holes and the flow of water through the holes together with the swirling movements of the feed slurry in the upper tank region being such that eddy currents are caused to form and to be maintained within each of the openings, the eddies having a distinct identifiable form and serving to promote transfer of particles of greater settling velocity from the upper to the lower region of the tank and through the holes.

9. A method as in claim 8 in which the water in the lower region of the tank is caused to swirl about the vertical axis of the tank.

10. A method as in claim 8 in which the barrier means employed is an annular plate portion, the method including causing particles of the slurry to progress downwardly in the upper tank region and to be directed laterally into the region immediately above said annular plate portion.

11. A method as in claim 8 in which the eddy currents maintained in the openings are such that one portion of eddy current surges upwardly on one side of an opening and another portion of eddy current surges downwardly on the opposite side of the opening, and additional portions of eddy current serve to connect the upper and lower ends of the side eddy current portions, the particles of greater settling velocity being carried through each opening in the downwardly surging eddy current portion.

12. A method as in claim 11 in which some particles of the slurry of lower settling velocity are carried upwardly in the upwardly surging eddy portion and delivered into the region above the barrier means.

* * * * *